US006626341B2

(12) United States Patent
Mitchell

(10) Patent No.: US 6,626,341 B2
(45) Date of Patent: Sep. 30, 2003

(54) MASSAGING BOOK BAG

(76) Inventor: Carter Mitchell, 333 W. Earle St., Greenville, SC (US) 29609

( * ) Notice: Subject to any disclaimer, the term of this patent is extended or adjusted under 35 U.S.C. 154(b) by 198 days.

(21) Appl. No.: 09/968,240

(22) Filed: Oct. 1, 2001

(65) Prior Publication Data

US 2003/0062391 A1 Apr. 3, 2003

(51) Int. Cl.[7] ..... A45C 15/00

(52) U.S. Cl. ..... 224/576; 224/643; 224/644; 601/57; 601/58

(58) Field of Search ..... 224/576, 643, 224/644, 647, 652; 601/46, 49, 56, 57, 58, 86, 90, 98

(56) References Cited

U.S. PATENT DOCUMENTS

| | | | | | |
|---|---|---|---|---|---|
| 4,136,685 | A | * | 1/1979 | Ramey | 601/57 |
| 4,343,303 | A | | 8/1982 | Williams | |
| 4,979,502 | A | | 12/1990 | Hunt | |
| 5,016,616 | A | | 5/1991 | Hu | |
| 5,097,822 | A | * | 3/1992 | Francis et al. | 601/101 |
| 5,429,585 | A | * | 7/1995 | Liang | 601/15 |
| D389,584 | S | | 1/1998 | Leventhal et al. | |
| 6,109,495 | A | * | 8/2000 | Hernandez | 224/644 |
| 6,193,678 | B1 | * | 2/2001 | Brannon | 601/15 |
| 6,524,263 | B2 | * | 2/2003 | Chen | 601/57 |

* cited by examiner

*Primary Examiner*—Stephen K. Cronin
(74) *Attorney, Agent, or Firm*—McNair Law Firm, P.A.

(57) ABSTRACT

A massaging backpack having at least one shoulder strap for massaging an individual which includes at least one massaging unit carried by the shoulder strap, at least one power supply carried by the backpack and connected to the massaging unit, and at least one actuating member carried by the backpack being connected to the massaging unit for actuating the massaging unit when the backpack is worn by the individual so that a massaging sensation is applied to selected areas of the individual.

24 Claims, 1 Drawing Sheet

MASSAGING BOOK BAG

FIELD OF THE INVENTION

This invention relates to a backpack, and in particular, to a backpack including a massaging unit for stimulating selected areas of an individual's body such as the shoulders and back.

BACKGROUND OF THE INVENTION

Massage therapy is a well-known treatment for relieving minor aches and pains associated with every day activities. Massage therapy works by increasing blood supply to the areas of the body stimulated by the massaging sensation. This therapy is useful in treating acute pains and spasms in the muscles brought on by either tension or injury to the muscles themselves.

Although a variety of different types of massaging apparatus have been developed for stimulating the muscles of selected body areas, such apparatus have not been effectively incorporated into common everyday items which can be worn by the individual for relieving stress throughout the day. For example, U.S. Pat. No 4,979,502 discloses several embodiments of massaging and heating apparatus to be worn by an individual. However, these devices are designed as stand alone therapeutic items and serve no other function. One of the embodiments shows a device with a heating apparatus located in the lower back portion of knapsack and a vibrating apparatus located in an extended neck portion of the device. This device is not designed to carry items, but simply to house the massaging apparatus and stimulate the individuals back and neck.

None of the prior body worn massaging devices have addressed the problem of providing a massaging apparatus in combination with a backpack, or similar heavy object worn by a person, to counteract the pressure and stress applied to the individual wearing the backpack when loaded. Accordingly, developing a portable massaging apparatus that is incorporated into a common backpack and the like for relieving stress associated with carrying heavy loads is a problem which considerable attention need be directed.

Therefore, it is an object of the present invention to provide a massaging unit incorporated in the strap of the backpack and the like for stimulating the muscles of the individual wearing the backpack to relieve stress associated with carrying heavy loads.

It is an object of this invention to apply massaging therapy to the shoulder of an individual to counteract the pressure of a loaded backpack.

SUMMARY OF THE INVENTION

The above objectives are accomplished according to the present invention by providing a massaging backpack for relieving muscle stress caused by carrying heavy loads with the backpack. The backpack comprises at least one shoulder strap for massaging an individual which includes at least one massaging unit carried by the shoulder strap, at least one power supply carried by the backpack and connected to the massaging unit, and at least one actuating member carried by the backpack being connected to the massaging unit for actuating the massaging unit when the backpack is worn by the individual so that a massaging sensation is applied to selected areas of the individual.

The massaging unit of the backpack includes a vibrating member producing vibrations stimulating the individual's shoulder. The backpack power supply comprises at least one replaceable battery carried by the backpack. The backpack also including a storage compartment for receiving an optional lower back massaging unit that is positioned in close proximity to the back of the individual wearing the backpack to apply a massaging sensation to the individual's back.

The actuating member of the backpack includes a pressure switch which automatically activates the massaging unit when pressure is applied to the actuating member. In the preferred embodiment, the pressure switch is carried by the massaging unit. The massaging unit includes an exterior bottom surface on which the pressure switch is disposed and carried within the shoulder strap for actuating the massaging unit according to pressure applied from the individual's shoulder when the individual is carrying the backpack. In an alternative arrangement, the pressure switch protrudes out through the shoulder strap for engaging a portion of the individuals shoulder when the individual is carrying the backpack. In another arrangement, the massaging unit includes an exterior top surface on which pressure switch is disposed and carried along within the shoulder strap for actuating the massaging unit according to pressure applied from the individual when the individual is carrying the backpack. The pressure switch can also be made to protrudes out through the shoulder strap for receiving pressure applied from the individual when the individual is carrying the backpack. In another embodiment, the backpack includes a pressure switch externally positioned on said backpack so that the individual can press the pressure switch to actuate said massaging unit when wearing said backpack.

The shoulder strap includes a foam core for cushioning the weight of the backpack when worn by the individual and the massaging unit is carried within the foam core. The shoulder strap also includes an access port comprising a re-sealable opening in the shoulder strap. The opening is formed from a slit cut into said shoulder strap which provides access to the massaging unit and actuating member when carried within the shoulder strap.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
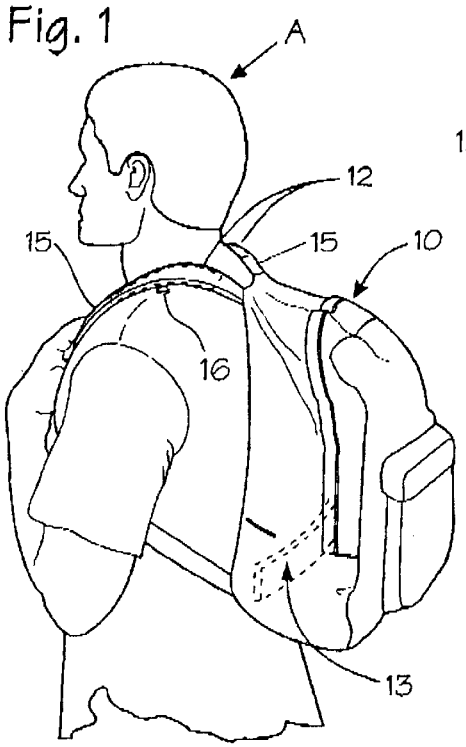
FIG. 1 shows a perspective view of an individual wearing a backpack according to the invention.

Referring to the drawings, the invention will now be described in more detail. FIGS. 1–3 show an individual A wearing a backpack 10 that includes a plurality of massaging units 12 and 13 carried by straps 15 for relieving stress associated with carrying heavy loads in the backpack. The intend behind placing the massaging units on or within the straps is to provide the stress relieving benefits of the massaging units or massaging therapy where they can be most effective. Since the shoulders support the vast majority of the weight of a backpack load, it is advantageous to locate the massaging units on that portion of the strap which rests on the top of the individual's shoulder. In order to provide additional stimulation and stress relief, massaging units may also be incorporated into a backpanel 30 of backpack 10 as well. As such, the invention essentially consists of massaging units 12 and 13, power supply 14, and pressure switch 16 mounted within cushioning 18 of straps 15 and backpanel 30 of backpack 10 in a manner known to those skilled in the art of massaging apparatus and as described herein below.

Figure 2A:
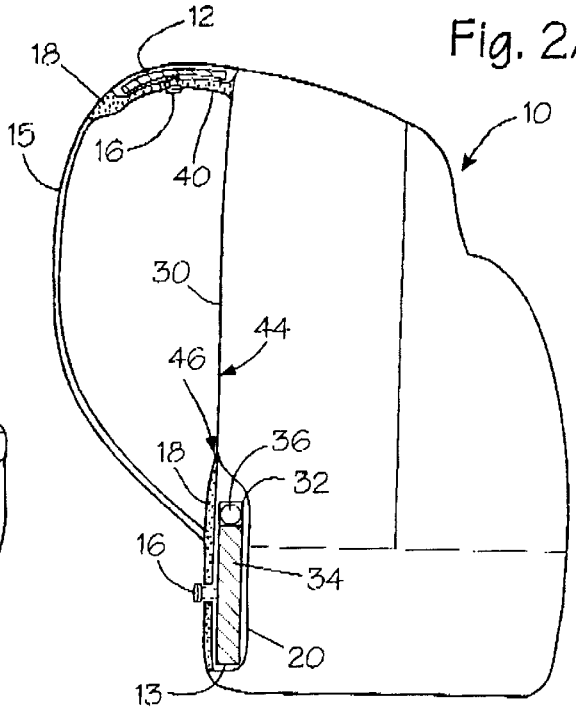
FIG. 2A is a side view of the backpack according to the invention.
Figure 2B:
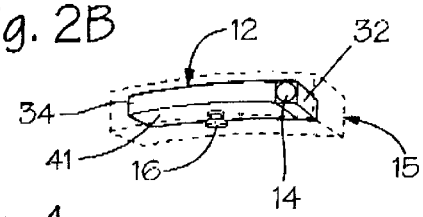
FIG. 2B is an exploded cross section of the shoulder strap according to the invention.

As best shown in FIG. 2B, the preferred embodiment of each individual massaging unit incorporates a compartment 32 for holding power supply 14, and a pressure switch 16. The pressure switch extends outward from the unit for actuating massaging units 12 and 13 when engaging the individuals shoulder under pressure. The massaging unit includes a vibrating member 34 that vibrates when pressure is applied to the switch in order to stimulate the area of the individual's body in proximity to the massaging units, preferably the top of the shoulders and lower back of the individual. Actuating switch 16 causes power to be applied to vibrating member 34 and thereby activating the vibrating member. The above components are used in each of the embodiments of the invention described herein. Their operation is believed to be sufficiently well known such that a detailed elaboration of the manner of their internal workings is not necessary to enable the invention to be practiced.

Power is supplied to the massaging unit via batteries 36 of a sufficient voltage to meet the energy requirement for the type and size of massaging unit used. In the preferred embodiment, each massaging unit includes compartment 32 for receiving at least one battery. A rechargeable battery is advantageous in this application. It is also to be understood from FIG. 3 that a centralized power supply 38 can be utilized to supply power to several massaging units, whether internally or externally, or mounted on straps 15 or backpanel 30. In both embodiments, however, the power supply can be separated from the massaging units in order to provide ease of access for changing or recharging the batteries. It should also be noted that the massing units themselves can be carried either internally or externally on straps 15 or backpanel 30 as described below.

Figure 3:
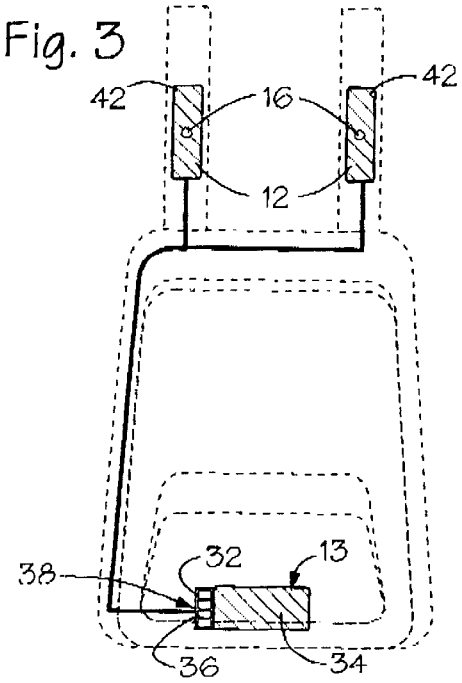
FIG. 3 is an front view of an alternative embodiment of the backpack according to the invention.

Referring to FIG. 2A, a side view of backpack 10 is shown that incorporates massaging units 12 and 13. To provide the most effective stimulation, at least one massaging unit is incorporated into straps 15 to support the majority of the weight in the backpack across the top of the individual's shoulders. Pressure switch 16 is shown protruding from bottom side 40 of strap 15 to engage the individual's shoulder and actuate the massaging unit when the individual is wearing the backpack. FIGS. 2B and 3 show alternative arrangements for the position of pressure switch 16. In FIG. 2B, the pressure switch extends from bottom side 41 of massaging unit 12 but is enclosed entirely within strap 15. In FIG. 3, the switch is located on a top side 42 of massaging unit 12 to allow the individual to selectively actuate the massaging unit. As with the embodiments shown in FIGS. 2A and 2B, the switch illustrated in FIG. 3 can be arranged to protrude through the top of strap 15 to directly contact the individual, or can be entirely contained within strap 15.

FIG. 3 shows the preferred arrangement of massaging units 12 and 13. One unit is located within the cushioning 18 of each strap 15 in such a position that the massaging units will rest approximately on the top of the individual's shoulder when wearing the backpack. A third lower back massaging unit 13 is then positioned within a storage compartment 20 of backpanel 30 in a position so that the unit will rest against the lower portions of the individual's back. As shown in FIG. 2A, third massaging unit 13 may also include a pressure switch of the type described above that may either protrude from the backpack or be entirely contained within storage compartment 20 adjacent to the individual's back. In the preferred embodiment, storage compartment 20 is carried on the interior surface 44 of backpanel 30 with a thin layer of cushioning 18 buffering third massaging unit 13 from the individual's back. Storage compartment 20 can also be formed within cushioning 18 of backpanel 30 when a thick layer of cushioning is provided. When the backpack is worn by the individual, the pressure of the items carried in the backpack force the backpack against the individuals back thereby creating a sufficient pressure to actuate pressure switch 16 and turn on massaging units 12 and 13.

In an alternative embodiment, massaging unit 12 can be carried externally on strap 15 as shown in FIG. 3. The unit can be secured externally on the strap by one of a number of common securing means such as elastic bands, straps, hook and loop connectors, snaps or other such common means. Also, the massaging unit may be placed in a pocket or pouch sewn to the top of the strap. The same methods can also be used to secure massaging unit 13 to interior 44 or exterior 46 surface of backpanel 30.

Figure 4A:
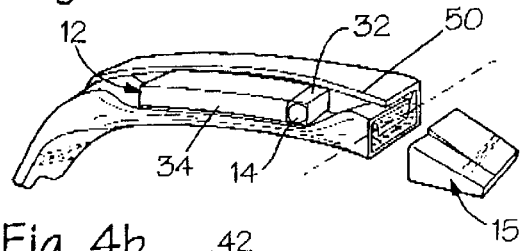
FIG. 4A is a cutaway side view of the shoulder strap access port according to the invention.
Figure 4B:
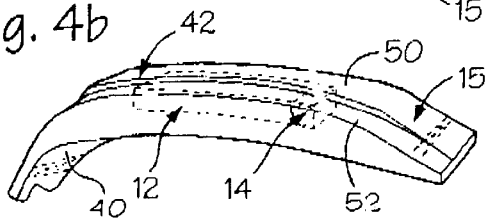
FIG. 4B is a side view of the shoulder strap access port in a closed position according to the invention.

In the preferred embodiment where the massaging units are carried within the straps, an access port is provided in the shoulder straps in order to access the massaging units or power supply. Referring to FIGS. 4A and 4B, the access port consists of a slit formed in top 42 or bottom 40 side of the strap material and covered by overlapping flaps 50 and 52. In the preferred embodiment, the flaps are secured together by hook and loop connectors carried by opposing sides of the flaps. When pushed together, the access port is secured in a closed position. Other securing members such as zippers, snaps, clips, can be used to secure the access port in a closed position. Furthermore, storage compartment 20 can also be provided with an access port as described above.

While a preferred embodiment of the invention has been described using specific terms, such description is for illustrative purposes only, and it is to be understood that changes and variations may be made without departing from the spirit or scope of the following claims.

What is claimed is:

1. A massaging backpack for relieving muscle stress caused by carrying heavy loads comprising:

a backpack having a compartment for carrying articles having a shoulder strap;

a massaging unit carried by said shoulder strap;

a power supply carried by said backpack and connected to said massaging unit; and an actuating member carried by said backpack being connected to said massaging unit for actuating said massaging unit when said backpack is worn by the individual, so that a massaging sensation is applied to selected areas of the individual.

2. The backpack of claim 1 wherein said massaging unit includes a vibrating member producing vibrations stimulating the individual's shoulder.

3. The backpack of claim 1 wherein said power supply comprises at least one replaceable battery carried by said backpack.

4. The backpack of claim 1 wherein said shoulder strap includes an access port;

said access port comprising a re-sealable opening in said shoulder strap; and said opening formed from a slit cut into said shoulder strap which provides access to said massaging unit and actuating member when carried within said shoulder strap.

5. The backpack of claim 1 including a storage compartment carried by said backpack for receiving a lower back massaging unit so that said lower back massaging unit is in close proximity with the back of the individual wearing said backpack to apply a massaging sensation to the individual's back.

6. The backpack of claim 5 including a lower back massaging unit carried by said storage compartment.

7. The backpack of claim 1 wherein said shoulder strap includes a foam core for cushioning the weight of said backpack when worn by the individual;

said massaging unit being carried within said foam core.

8. The back pack of claim 7 wherein said slit forming said access port includes overlapping flaps; and said flaps carrying hook and loop connectors disposed along adjacent sides of said flaps for securing said access port in a closed position when said flaps are pressed together.

9. The backpack of claim 1 wherein said actuating member includes a pressure switch which automatically activates said massaging unit when pressure is applied to said actuating member.

10. The backpack of claim 9 wherein said pressure switch is externally positioned on said backpack so that the individual can press the pressure switch to actuate said massaging unit when wearing said backpack.

11. The backpack of claim 9 wherein said pressure switch is carried by said massaging unit.

12. The backpack of claim 11 wherein said massaging unit includes an exterior bottom surface; said pressure switch being disposed along said exterior bottom surface within said shoulder strap for actuating said massaging unit according to pressure applied from the individual's shoulder when the individual is carrying said backpack.

13. The backpack of claim 12 wherein said pressure switch protrudes out through said shoulder strap for engaging a portion of the individual's shoulder when the individual is carrying said backpack.

14. The backpack of claim 11 wherein said massaging unit includes an exterior top surface; said pressure switch being disposed along said exterior top surface within said shoulder strap for actuating said massaging unit according to pressure applied from the individual's shoulder when the individual is carrying said backpack.

15. The backpack of claim 14 wherein said pressure switch protrudes out through said shoulder strap for receiving pressure from the individual when the individual is carrying said backpack.

16. A massaging backpack unit for use with a backpack and the like comprising:

at least one massaging unit carried by at least one shoulder strap;

at least one power supply carried by said massaging unit and operatively associated with said massaging unit; and at least one actuating member carried by said massaging unit for automatically actuating said massaging unit when pressure is applied to said actuating member from the individual's shoulder when wearing said backpack, so that a massaging sensation is applied to selected areas of the individual.

17. The backpack of claim 16 wherein said massaging unit includes a vibrating member producing vibrations stimulating the individual's shoulder.

18. The backpack of claim 16 wherein said power supply comprises at least one replaceable battery.

19. The backpack of claim 16 wherein said actuating member is a pressure switch externally positioned on said backpack so that the individual can press said pressure switch to actuate said massaging unit when wearing said backpack.

20. The backpack of claim 16 including a storage compartment carried by said backpack for receiving a lower back massaging unit so that said lower back massaging unit is in close proximity with the back of the individual wearing said backpack to apply a massaging sensation to the individuals back.

21. The backpack of claim 20 including a lower back massaging unit carried by said storage compartment.

22. The back pack of claim 16 wherein said shoulder strap includes a foam core for cushioning the weight of said backpack when worn by the individual; and said massaging unit being carried within said foam core.

23. The backpack of claim 22 wherein said shoulder strap includes an access port;

said access port comprising a re-sealable opening in said shoulder strap; and said opening formed from a slit cut into said shoulder strap which provides access to said massaging unit and actuating member when carried within said shoulder strap.

24. The backpack of claim 23 wherein said slit forming said access port includes overlapping flaps; and said flaps carrying hook and loop connectors disposed along adjacent sides of said flaps for securing said access port in a closed position when said flaps are pressed together.

* * * * *